US006205722B1

(12) United States Patent
Bromley et al.

(10) Patent No.: US 6,205,722 B1
(45) Date of Patent: Mar. 27, 2001

(54) MOLDED PLASTIC STAIRWAY AND RAIL STRUCTURE AND METHOD OF ASSEMBLY

(75) Inventors: Jan W. Bromley; Rex McCorquodale, both of Houston, TX (US)

(73) Assignee: Lone Star Steps Accessories, Inc., Orange, TX (US)

( * ) Notice: Subject to any disclaimer, the term of this patent is extended or adjusted under 35 U.S.C. 154(b) by 0 days.

(21) Appl. No.: 09/290,213

(22) Filed: Apr. 13, 1999

(51) Int. Cl.[7] ..... G04F 11/00
(52) U.S. Cl. ..... 52/182; 52/183; 52/184
(58) Field of Search ..... 52/182, 188, 191, 52/183–184

(56) References Cited

U.S. PATENT DOCUMENTS

| | | | | |
|---|---|---|---|---|
| 815,840 | * | 3/1906 | Knaus | 52/182 |
| 3,706,170 | | 12/1972 | Argraves et al. . | |
| 5,349,795 | * | 9/1994 | French | 52/183 |
| 5,402,610 | * | 4/1995 | Salva | 52/182 |
| 5,454,196 | * | 10/1995 | Gaines | 52/183 |
| 5,522,182 | * | 6/1996 | Rogers | 52/9 |
| 5,737,884 | * | 4/1998 | Schrom | 52/187 |
| 5,941,030 | * | 8/1999 | Williamson | 52/182 |

* cited by examiner

*Primary Examiner*—Beth A. Stephan
(74) *Attorney, Agent, or Firm*—Gary L. Bush; Mayor, Day, Caldwell & Keeton, LLP

(57) ABSTRACT

A stairway (10) is shown in FIGS. 1 and 2 in one embodiment of the invention in which a pair of side support panels (12, 14) are formed of a hollow plastic material. Side support panels (12, 14) have closed end columns (24, 26, 28) extending from an outer face of the side support panels to provide a relatively large bearing area. Another embodiment of a stairway (10A) shown in FIGS. 3–5 has a side rail panel (40A) positioned on a lower side support panel (12A) with wooden posts (32A) received in open ended columns (24A, 26A, 28A) of lower side support panel (12A) and received within columns (42A, 44A and 46A) of side rail panel (40A). Posts (32A) are normally embedded in concrete (36A) for securement of the stairway (10A).

24 Claims, 3 Drawing Sheets

MOLDED PLASTIC STAIRWAY AND RAIL STRUCTURE AND METHOD OF ASSEMBLY

BACKGROUND OF THE INVENTION

Field of the Invention

This invention relates to molded plastic stairway and rail structures, and the method of assembly. More particularly, the invention relates to hollow molded side support panels and side rail panels used on stairway and deck structures.

BACKGROUND OF THE INVENTION

Heretofore, various types of stairways have been provided in which side panels have been formed with grooves or pockets to receive treads. For example, U.S. Pat. No. 815,840 dated Mar. 20, 1906 shows a stair in which a pair of flat side plates are formed with pockets on grooves to receive treads and risers. However, such a stair or stairway is not self supporting and is adopted to abut a supporting structure such as a wall or other support.

The side members for supporting treads and risers have been formed heretofore of various materials, such as wood, metal, cement or a solid plastic. For example, U.S. Pat. No. 3,706,170 dated Dec. 19, 1972 illustrates a stairway in which the sides are formed of a solid plastic material with opposed planar surfaces. Columns are not formed on the sides and the stairway is supported by its weight on a horizontal supporting surface without any separate support members, such as posts embedded in the supporting surface.

It is desired that hollow molded plastic side support panels and side rail panels be provided for stairway and deck structures, particularly for outdoor use.

SUMMARY OF THE INVENTION

This invention relates to side support panels and side rail panels for stairway and deck structures particularly for outdoor use. The side support and rail panels are formed of a hollow construction from a molded plastic material. The outer surfaces or sides of lower side support panels have a plurality of spaced integral vertical columns thereon which extend outwardly from the outer faces of the panels. In one embodiment for a stairway, the side support panels support treads and the vertical columns have closed ends for supporting the stairway on a horizontal supporting surface. In another embodiment, the hollow columns have open ends to receive wooden posts which are embedded in the supporting surface for anchoring the stairway.

Side rail panels have vertical columns connected by upper and lower rails. The vertical columns are hollow and have open lower ends to receive wooden support posts embedded in the supporting surface. When combined with lower side support panels, the columns are vertically aligned with the posts extending within vertically aligned columns. The columns on the upper rail panels have open lower ends to receive the posts and closed upper ends for ornamental purposes. The upper rail panels form a continuation of the lower side support panels and are supported thereon.

Other features and advantages of the invention will be apparent from the following specification and drawings.

DESCRIPTION OF THE INVENTION

Figure 1:
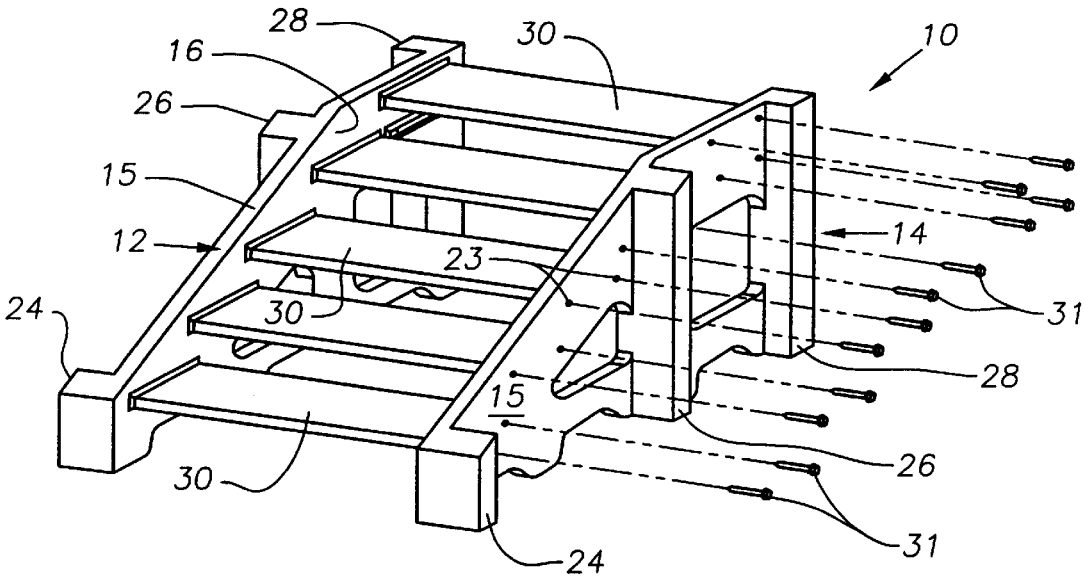
FIG. 1 is a perspective of a completed stairway of one embodiment of the invention showing wooden treads received within molded tread supports with the stairway supported on a horizontal supporting surface.
Figure 2:
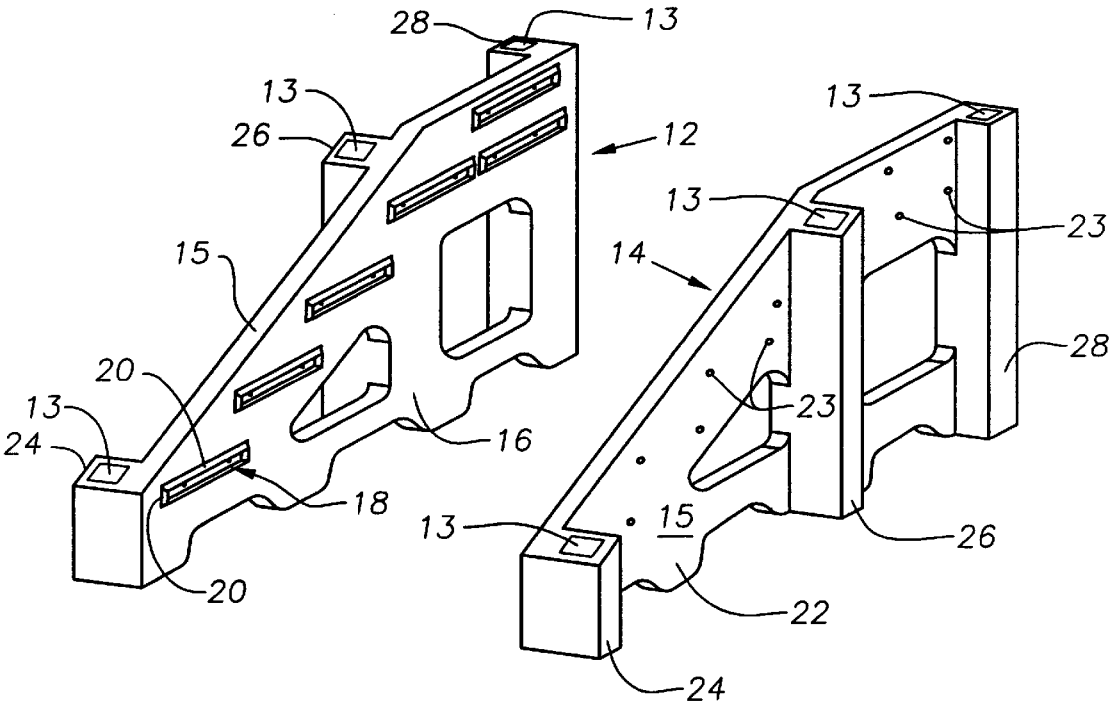
FIG. 2 is a perspective view of a pair of hollow side support panels of the embodiment of FIG. 1 formed of a molded plastic material and arranged in parallel relation to each other with hollow vertical columns extending from an outer side of the panels.

Embodiment of FIGS. 1 and 2

Referring now particularly to FIGS. 1 and 2 in which one embodiment of the invention is illustrated for a stairway shown generally at 10 in FIG. 1, a pair of molded plastic side panels 12 and 14 as shown in parallel relation to each other to form opposite sides of stairway 10. Each side panel 12, 14 has a body 15 of a hollow plastic construction formed from a suitable mold and including an inner face 16 with tread pockets 18 formed therein. Suitable molding strips 20 are formed about pockets 18. Each side panel 12, 14 has an outer face 22 with hollow end columns 24, 28 and an intermediate column 26 extending outwardly from face 22. Columns 24, 26 and 28 have closed ends and provide a relatively large bearing area or surface for supporting the stairway on a supporting surface.

For assembly, wooden treads 30 are inserted in pockets 18 on side panel 12. Side panel 14 is then pushed against the opposite ends of treads 30 for positioning of treads 30 within pockets 18. Next, fasteners 31 are inserted into the ends of treads 30 through side support panels 12 and 14. Openings 23 for fasteners 31 are preferably preformed prior to insertion of fasteners 31 which preferably comprise lag bolts. Openings shown generally at 23 preferably are preformed "bullets" in the body of each side support panel 12, 14 to receive the lag bolts. Such bullets include a molded indentation are the outer sides of panels 12, 14 which register with pockets 18 on the inner sides of such panels. Columns 24, 26 and 28 have closed ends to provide relatively large lower bearing areas for supporting of stairway 10 on a lower supporting surface normally at ground level. As shown in FIG. 2, the top or closed end of columns 24, 24, 28 have indentations 13 which close such columns to rain and debris, but which can be cut away to allow the hollow column to have a post inserted through such columns as illustrated in FIGS. 3–5.

Figure 4:
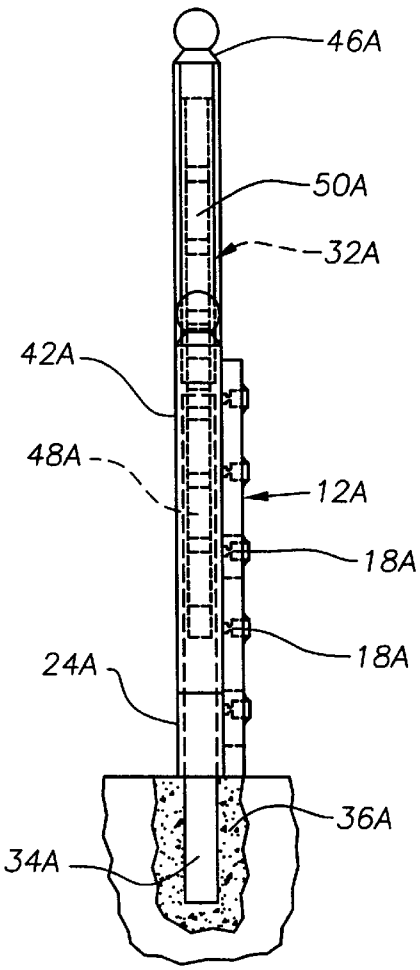
FIG. 4 is a front elevational view of a stairway side looking generally along line 4—4 of FIG. 3.
Figure 3:
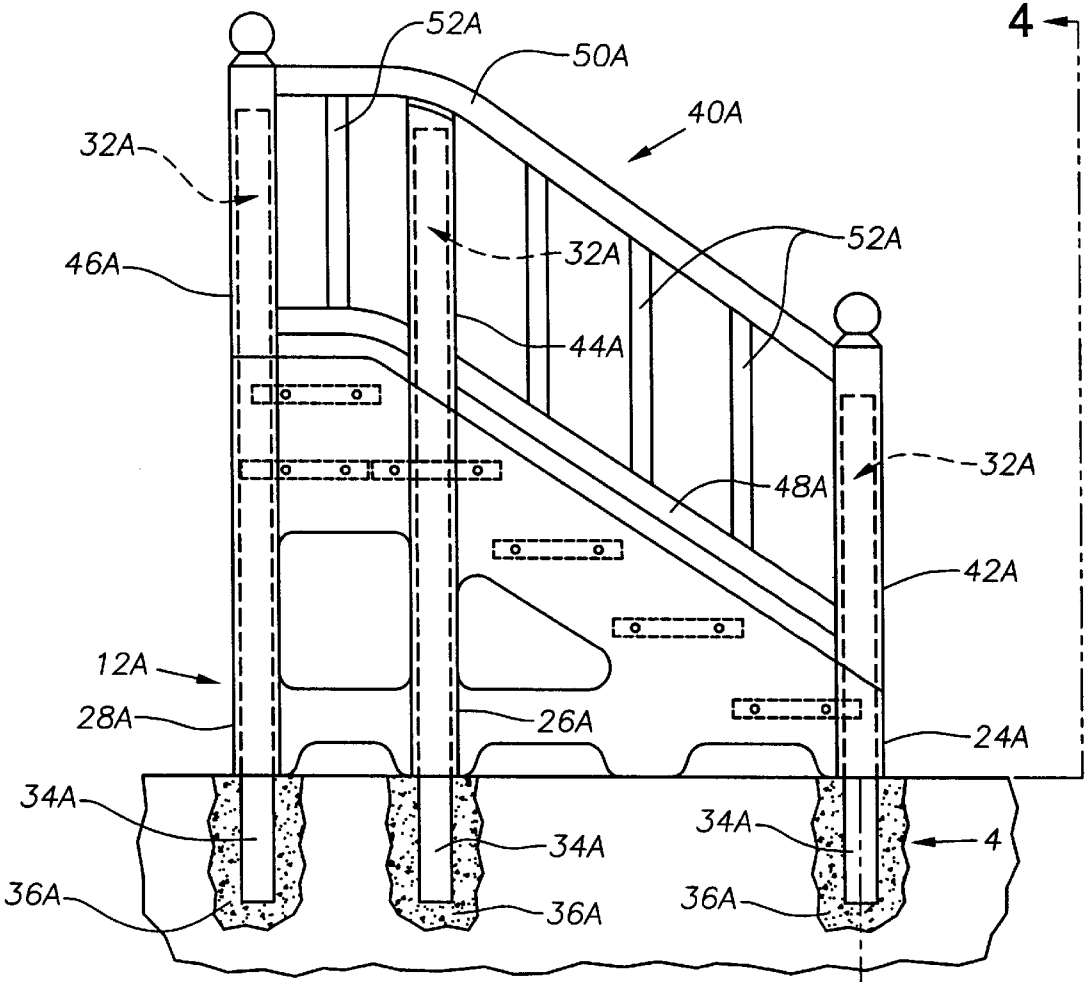
FIG. 3 is a side elevation of another embodiment of the invention in which a stairway includes an upper side rail panel positioned over a lower side support panel with embedded wooden posts being received within aligned hollow columns for mounting of the panels.
Figure 5:
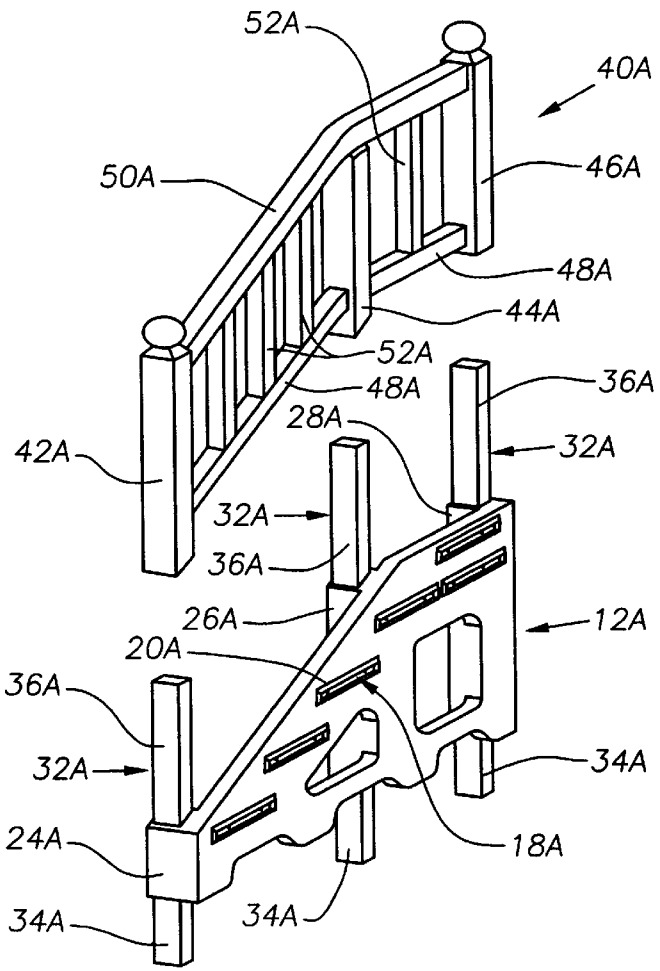
FIG. 5 is an exploded view of the stairway side shown in FIG. 4 showing the upper side rail panel above a vertically aligned lower side support panel for being lowered onto projecting end portions of the wooden posts.

Embodiment of FIGS. 3–5

Referring to FIGS. 3–5, another embodiment of a stairway is shown in which embedded side post structures are provided for support of stairway 10A. A side support panel 12A is the same side support panel 12 in the embodiment of FIGS. 1 and 2 except that the top plastic indentation 13 has been cut away to produce open ends for columns 24A, 26A 28A and as a result are adapted to receive wooden posts 32A therein. Wooden posts 32A as shown particularly in FIG. 3 have lower end portions 34A which are suitably embedded in concrete 36A in the ground or supporting surface. Posts 32A are received within columns 24A, 26A and 28A and have upper end portions 36A extending above associated side support panel 12A as shown in FIG. 5. Wood posts 32A are preferably of a four (4) inch by four (4) inch square cross section. Posts 32A may be cut at their upper ends to provide a desired projecting height for upper end portions 36A.

To provide a side rail structure for stairway 10A, an upper side rail panel 40A is provided having hollow columns 42A, 44A and 46A arranged for vertical alignment with subjacent columns 24A, 26A and 28A. Columns 42A, 44A and 46A have open lower ends and closed upper ends. Lower rails 48A and upper rails 50A extend between columns 42A, 44A and 46A. Posts 52A extend between rails 48A and 50A. Upper side rail panel 40A as shown in FIG. 5 is lowered onto the lower side support panel 12A as shown in FIG. 5 with post end portions 36A received within hollow open ended columns 42A, 44A and 46A which form a smooth continuation of lower columns 24A, 26A and 28A and are supported thereon. A side rail panel 40A may be positioned on both or only one side of stairway 10A as desired.

Also, a side rail panel similar to side rail panel 40A as shown in FIGS. 3–5 may be provided for a deck or porch with posts extending upwardly from the deck or porch and the side rail panel lowered onto the posts to receive the posts in the open ended hollow columns. For use on a deck, upper and lower rails of the side rail panel would normally extend in a horizontal direction.

Figure 6:
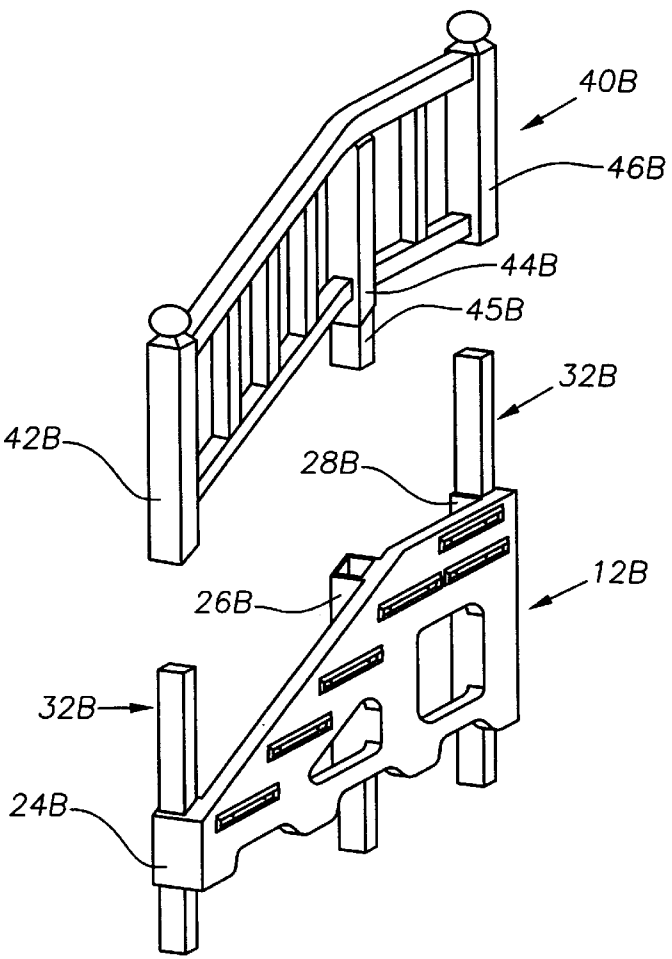
FIG. 6 is an exploded view similar to FIG. 5 but showing a modified side of a stairway in which the upper side rail panel has a lower column extension received within an aligned hollow column on a subjacent side support panel.

Embodiment of FIG. 6

Referring to FIG. 6, a modified side rail panel 40B is shown similar to side rail panel 40A of FIGS. 3–5 except for intermediate column 44B which has a projecting lower end portion 45B of a size to fit within intermediate column 26B of a subjacent side support panel 12B. Side support panel 12B is identical to side support panel 12A of FIGS. 3–5 except for the absence of an intermediate post for intermediate column 26B. End posts 32B are provided for end columns 24B, 28B and 42B, 46B.

The various embodiments as shown above may be packaged in a kit for use by a workman for installation of a stairway or side railing, for example.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A stairway comprising:

a pair of spaced side support panels extending in a parallel opposed relation to each other, each side support panel of said pair of support panels formed from a molded plastic material and having an inner side which is arranged and designed to face an inner side of the other side support panel with each of said side support panels having at least two integral support columns of a hollow construction which extend outwardly from a respective inner side of each of said side panels, said columns arranged and designed for supporting the panels;

each side support panel of said pair of molded plastic side support panels having a plurality of tread supports molded therein which open on a respective inner side thereof, with the tread supports of one side support panel being in transverse horizontal alignment with the tread support on the other side support panel; and a plurality of treads mounted in said transversely aligned tread supports.

2. The stairway of claim 1 wherein, said integral support columns have closed upper and lower ends, said lower ends supporting the side support panels on a generally horizontal supporting surface.

3. The stairway of claim 1 wherein, said integral support columns of a hollow construction have open upper and lower ends to form receptacles, and a plurality of wooden support posts extend vertically through said receptacles and are secured adjacent lower end portions thereof for mounting said side support panels at a predetermined location.

4. The stairway of claim 3 wherein, said wooden posts have upper end portions which extend above said side panels, and a side rail panel is mounted on said wooden posts over each of said side support panels.

5. The stairway of claim 4 wherein, said side rail panels have a plurality of columns in axial vertical alignment with said columns on said side support panels; and said wooden posts are received within said aligned columns for supporting said side support panels and said side rail panels.

6. The stairway of claim 5 wherein, each side rail panel includes an upper rail, a lower rail, and a plurality of posts secured between said upper and lower rails.

7. A side rail structure along the side of a walkway comprising:

a vertically extending base support panel having a plurality of lower post receptacles spaced along one side thereof;

a vertical supporting post mounted within each of at least two of said receptacles, each post having an upper end portion extending vertically above one of said at least two receptacles; and a side rail panel having a plurality of upper post receptacles in axial alignment with said lower post receptacles and receiving the upper end portions of said posts therein.

8. The side rail structure of claim 7 wherein, a pair of base support panels are arranged in parallel spaced relation to each other, each base support panel having a plurality of tread supports on an inner side thereof; and a plurality of treads mounted between said base support panels on said tread support thereby to support said treads thereon.

9. The side rail structure of claim 7 wherein, said base support panel and said side rail panel are formed of a molded plastic material and said post receptacles are hollow to receive the vertical supporting posts therein.

10. The side rail structure as set forth in claim 7 wherein, said side rail panel has an upper rail, a lower rail, and a plurality of vertical posts received between said upper and lower rails.

11. A stairway comprising:

a pair of spaced lower side support panels in parallel relation to each other, each panel including at least two integral lower support columns of a hollow construction;

a plurality of treads supported on said lower side support panels;

a pair of upper side rail panels over said lower side support panels and having upper support columns of a hollow construction in axial alignment with said lower support columns; and support posts received within said axially aligned upper and lower hollow support columns for mounting of said support panels and said lower side support panels in vertically aligned relation.

12. The stairway of claim 11 wherein, said columns on said lower support panels have open upper and lower ends to receive said posts, and said columns on said upper side panels have open lower ends to receive said posts.

13. The stairway of claim 12 wherein, said side support panels and said side rail panels are formed of a molded plastic material and said posts are formed of wood.

14. The stairway of claim 13 wherein, said side support panels have tread supports molded on opposed inner sides of said side support panels; and said treads are formed of wood and mounted on said tread supports.

15. A method of fabricating a stairway comprising the steps of, molding a pair of self supporting side support panels with each support panel of said pair of panels having an inner side and an outer side, with each support panel having a plurality of open ended hollow support columns on said outer side and plurality of tread supports which open from said inner side;

mounting treads on said tread supports of said side support panels; inserting posts within said columns for mounting said side support panels at a predetermined position with upper end portions of said posts extending above said side support panels;

molding a pair of upper side rail panels having hollow support columns thereon spaced for alignment with said columns on said side support panels; and mounting said upper side rail panels over said side support panels with the upper end portions of said extending posts being received within the hollow columns of said upper side rail panels.

16. The method of claim 15 further including the steps of, providing at least one of said columns on each of said upper rail panels with a downwardly extending lower end portion of reduced dimensions; and inserting said downwardly extending lower end portion within an open end of an aligned column on an associated subjacent side support panel.

17. A method of fabricating a stairway comprising the steps of, molding a pair of self supporting side support panels with each support panel having an outer side and an inner side, with a plurality of hollow vertical support columns provided on said outer side of each of said support panels and extending vertically of the side support panel for supporting the side support panel on a generally horizontal supporting surface;

molding a plurality of tread supports which open from the inner side of each side support panel;

positioning said side support panels in parallel relation to each other with the tread supports opening from one panel in alignment with the tread supports opening from the other side support panel;

inserting treads within the aligned tread supports; and inserting fasteners to secure the treads to said side support panels.

18. The method of fabricating a stairway of claim 17 wherein said molding step includes the substep of, molding said hollow vertical support columns on front and back ends of said self supporting panels.

19. A side structure for a stairway comprising:

a side support panel formed of molded plastic material and having an inner side, an outer side and front and back ends, said support panel having at least two integral support columns of hollow construction for supporting the panels, said support panels having a plurality of tread support molded therein which open from said inner side and are arranged and designed for mounting an end of a step tread.

20. The side structure of claim 19 wherein, said two integral support columns extend outwardly from said outer side.

21. The side structure of claim 19 wherein, each of said two integral support columns are arranged and designed to receive a post from a bottom end of said panel.

22. The side structure of claim 21 wherein, said two integral support columns each have an opening at a top end which is arranged and designed to pass a portion of said post through its top end.

23. The side structure of claim 19 wherein, said at least two integral support columns are positioned at said front and back ends.

24. The side structure of claim 23 further comprising a third integral support column positioned between said at last two integral support columns at said front and back ends.

* * * * *